US005988350A

United States Patent [19]

Nusime et al.

[11] Patent Number: 5,988,350

[45] **Date of Patent: *Nov. 23, 1999**

[54] ESCALATOR STEP

[75] Inventors: Harold Nusime, Steyr; Wolfgang Neszmerak, Wien, both of Austria

[73] Assignee: Invento AG, Hergiswil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/855,927

[22] Filed: May 14, 1997

[30] Foreign Application Priority Data

May 30, 1996 [EP] European Pat. Off. ..... 96810345

[51] Int. Cl.[6] ..... B66B 23/12

[52] U.S. Cl. ..... 198/333

[58] Field of Search ..... 198/333

[56] References Cited

U.S. PATENT DOCUMENTS 2,570,135 10/1951 Loughridge ..... 198/16

4,413,719 11/1983 White ..... 198/333

5,358,089 10/1994 Riedel ..... 198/333

FOREIGN PATENT DOCUMENTS 0276578 8/1988 European Pat. Off. ..... B66B 23/12

2717666 10/1978 Germany ..... B66B 9/12

9222491 12/1992 WIPO ..... B66B 23/12

*Primary Examiner*—Jospeh E. Valenza

*Attorney, Agent, or Firm*—Schweitzer Cornman Gross & Bondell LLP

[57] ABSTRACT

The present invention relates to an aluminum die-cast escalator step with a reinforcing addition, by means of which the load capacity and thus the fracture load limit of the step body (1) 15 increased. In an unchanged compact step body (1), a stiffening section (6) is fastened in the transverse direction at the rear part at its underside (16). Side struts (15) are reinforced by enclosing side parts (7, 8) wherein the rims of the side surfaces of the side parts (7, 8) lie against the underside (16) and against the rear side (17) of the step body (1). A metal ring is welded to the side plate and encloses the stub axle pin of the step body. The stiffening section (6) has an asymmetric U shape.

4 Claims, 3 Drawing Sheets

ESCALATOR STEP

The present invention relates to a compact escalator step body, preferably of the aluminum die-casting type having a tread surface and step front, and side struts with guide rollers, which fulfills special requirements for a higher fracture load limit.

BACKGROUND OF THE INVENTION

Compact escalator steps used world-wide today exhibit fracture loads of 20 to 25 kilonewtons for a centrally applied load. In individual special cases of application, appropriate specifications may demand that the fracture load limit must lie at 2.5 tonnes for a force application at any desired place of the tread surface.

In the case of force application at any desired place of the tread surface, the afore-mentioned fracture load levels are not reached and supported by normal compact steps, because particularly high forces in the region of the step roller bearing result from such loads and this part of the compact step is not dimensioned for such a degree of loading. To fulfill this requirement, new constructions for compact steps and thus new, expensive die-casting molds must be created. The consequence of such a solution would be very high costs for a small number of pieces and thus substantially higher installation costs for an escalator of this kind.

Another solution consists of an appropriately stronger step being assembled in a different manner, utilizing a compound mode of construction, thus requiring different parts and materials. A step of the afore-mentioned kind is shown in U.S. Pat. No. 2,570,135. The step body is assembled from longitudinal and transverse carriers, front metal plate and tread plate. Guide and carrying rollers are screw-fastened by their bearing blocks at the longitudinal carriers. With use of appropriately dimensioned parts, a sufficiently strong tread step can in principle be produced in this manner. However, the manufacturing costs of such a step becomes so high that alternative solutions are needed.

It is therefore the object of the present invention to create an escalator tread step for higher fracture loads, which does not exhibit the disadvantages of the afore-mentioned solutions and for which existing constructions can be further used as far as possible.

The invention distinguishes itself in that an available compact step may be used in unchanged form as starting product, to which reinforcing elements for additional longitudinal and transverse stiffening are fastened at appropriate places.

The reinforcing elements for each step may be a bent-over section and a respective side plate with an encompassing rim, which are screw-fastened to the compact step at places to be reinforced. The reinforcing elements may be screw-fastened in force-lockingly manner at surfaces of existing ribs and webs of the compact step. Apart from the drilling of a few holes and the cutting of a pair of threads, no further adapting operations need be applied to the existing compact step. In particular, the reinforcing ribs that are present can remain in their original shape and maintain their function.

BRIEF DESCRIPTION OF THE DRAWINGS

The invention is explained more closely in the following by reference to an example of embodiment and is illustrated in the drawings, in which.

DETAILED DESCRIPTION OF THE INVENTION

Figure 1:
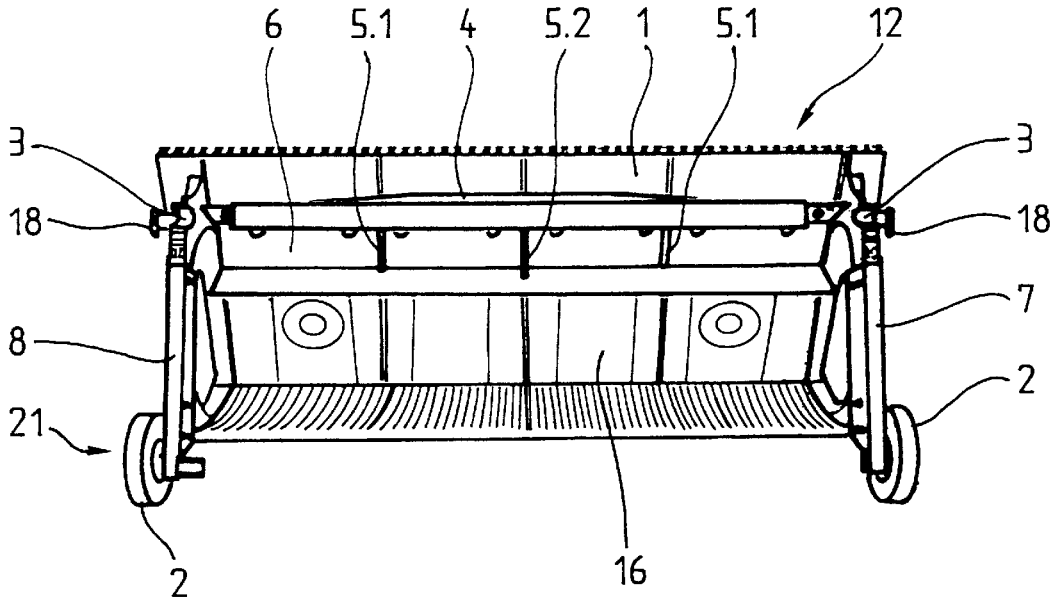
FIG. 1 shows a reinforced step in an overall view from below.

An escalator step body, which is produced in aluminum die-casting in a known usual manner, is denoted by 1 in FIG. 1. The carrier rollers are denoted by 2 and the entraining bearings by 3. The carrier rollers 2 are fastened on stub axle pins 21. Sliding guide shoes 18 project from the step body 1 laterally behind the entraining bearings 3. The step body 1 furthermore has an underside 16 with a central, longitudinally-extending reinforcing rib 5.2 and respective further, parallel-extending reinforcing ribs 5.1 at some spacing on each of the two sides of the reinforcing rib 5.2. A rear transverse rib 4 extends over the entire underside 16, is greatly heightened in the middle portion and tapers at both sides into the base of the entraining bearing 3. The present invention incorporates a stiffening section member reinforcement element 6, which is inserted to lie against the transverse rib 4 and against the underside 16. The side struts of the step body (not visible in this figure) are enclosed by side plate reinforcement elements 7 and 8, respectively. The tread surface, which in this figure is visible only as a rim, is denoted by 12.

Figure 2:
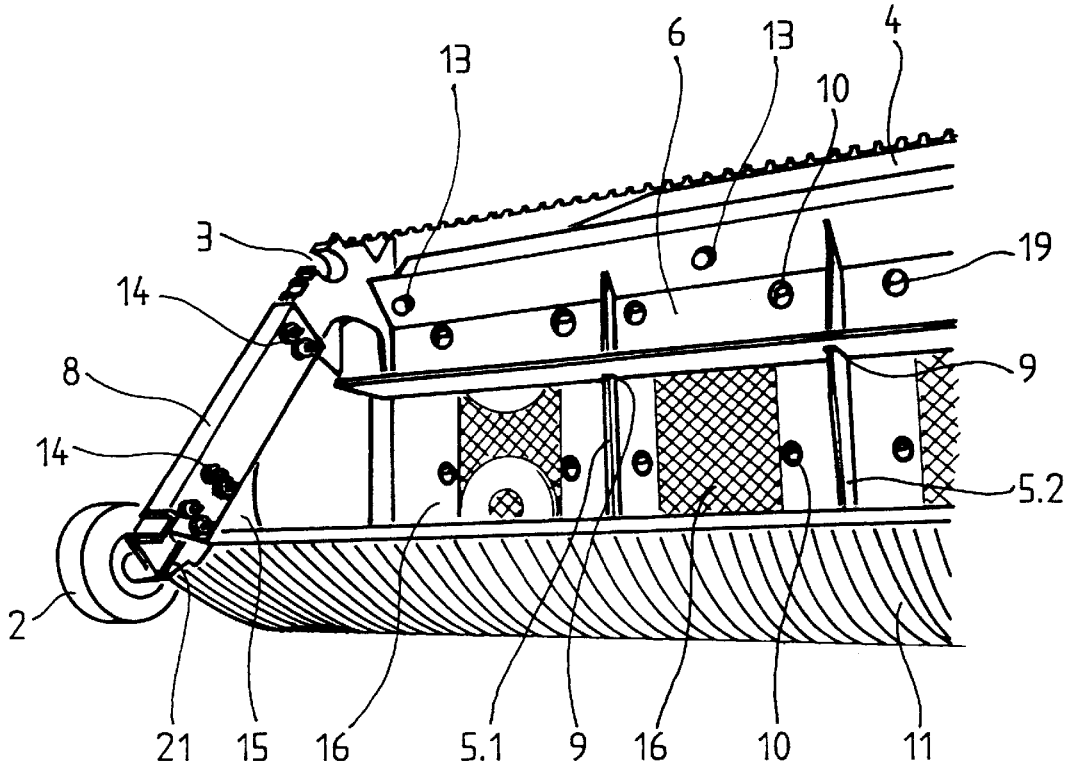
FIG. 2 shows details of the reinforcing elements and their fastening.

The manner of fastening of the reinforcing elements is evidently substantially in FIG. 2. The front surface 11 of the step body 1 is still visible at the lower edge of the figure. The side plate 8 enclosing side strut 15 is firmly connected to the side strut 15 by screws 14 passing therethrough; a rim of the side surface of the side plate lies against the underside 16 of the step body 1. Stiffening section 6 is fastened against the transverse rib 4 by screws 13, and rests with its bent-up rear side on the transverse rib 4, and with its base surface flush against the underside of the step body. The rear side of the stiffening section 6 has a further inward bend to increase the moment of resistance at its upper rim. The stiffening section 6 also has a second bent-up wall on its front side so that its cross-section represents approximately a capital U profile with an asymmetric cross-section. In order that no milling operations need be made to the step body 1 before the fastening of the stiffening section 6, the underside of the stiffening section 6 has appropriate recesses 19 at those locations where projecting sprue spigots 10 are present in the underside 16 of the step body 1. Recesses 9 in the stiffening section 6 also bridge over the longitudinally arranged reinforcing ribs 5.1 and 5.2 of the step body, so that those elements can be left in their original shape to perform their original function. With this arrangement and construction of the stiffening section 6, the desired increased load capacity of the step body 1 at its rear portion of the tread surface 12 is achieved.

Figure 3:
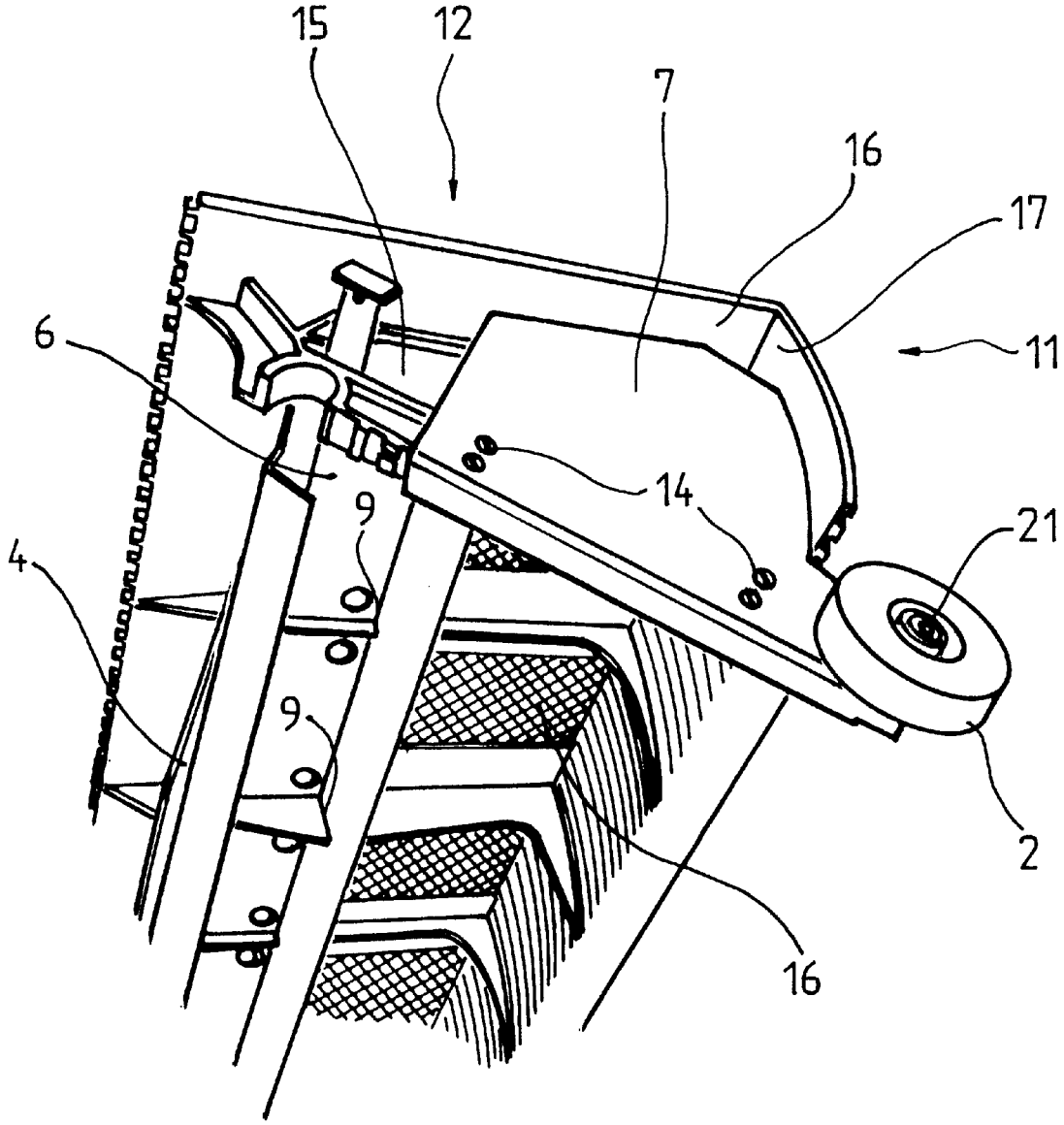
FIG. 3 shows a side view from below with details of the side plates.

FIG. 3 allows the construction of the side plate reinforcement elements, and particularly, side plate 7, to be depicted. The side plate lies at its front rim against the rear side 17 of the step front 11 and by its upper rim against the underside 16 of the step body 1. The combination of a three-sided enclosure of the side strut 15 coupled with the rims of the side plate 7, lying against the inward sides of the step body 1 result in the desired reinforcement of the side portion of the step body 1.

Figure 4:
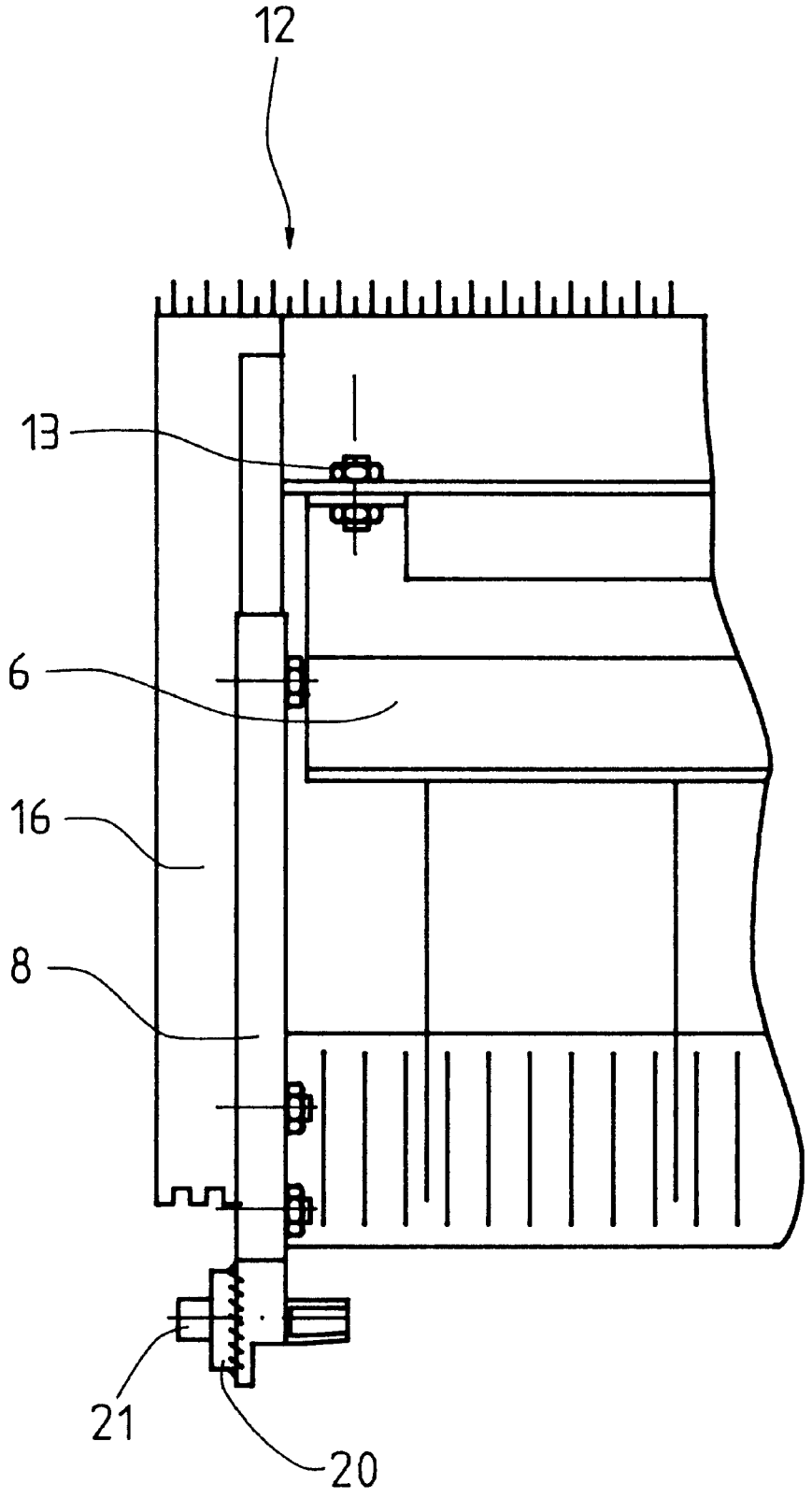
FIG. 4 shows a constructional detail of the side plate.

FIG. 4 shows a further important constructional detail of the side plates 7 and 8 which is not visible in the preceding figures. Metal ring 20 encloses the stub axle pin 21, and is welded to the side plate 8 at its corner in the region of the stub axle 21. A continuous reinforcement of the side strut 15 from the stub axle pin 21 to the underside 16 of the tread surface 12 is thereby achieved.

The present invention thus provides for the reinforcement of a step body 1 for higher fracture loads and results, with tolerable expenditure, in a stronger step body 1 for increased load demands. Thus, two different step types can be provided through provision of a basic type and use of the three reinforcing elements 6, 7 and 8. The additional installation of the reinforcing elements 6, 7 and 8 takes only a few minutes for each step body 1 and the reinforcing elements 6, 7 and 8 themselves can be prefabricated as mass-produced parts at favorable costs.

The installation of the reinforcing elements 6, 7 and 8 is simple insofar as all holes for the screw-fastening to the step body I are punched into the reinforcing elements 6, 7 and 8 in advance. The reinforcing elements 6, 7 and 8 can then serve as drill gauges for the drilling of the passage holes and threaded holes in the step body 1. Thus, the stiffening section 6 need only be laid upon and drilled together with the transverse rib 4. The side plates 7 and 8 are placed onto the respective stub axle pin 21 together with the welded-on metal ring 20, and then turned until they lie against the underside 16 of the tread surface 12 and against the rear side 17 of the step front 11. Properly positioned, the drilling of the side plates 7 and 8 takes place and the side struts 15 are screwed or riveted to the side plates as required.

Advantageously, stainless or corrosion-protected sheet metal may be used as the material for the reinforcing elements 6, 7 and 8. The screw connections can additionally be supported by the application of gap-filling adhesive substance between the contact surfaces. In place of screw connections for the fastening of the reinforcing elements 6, 7 and 8, riveting techniques can also be applied.

With further bending-over shapes and material thicknesses of the stiffening section 6, its resistance moment can be varied within wide limits. In the case of the metal side plates 7 and 8, the specific bending geometry and the outline of the side surface is dictated by the manner of deployment. A variation of the load capacity can be achieved within certain limits by the choice of the material and its thickness.

We claim:

1. A reinforcement kit for use in conjunction with an escalator step body having a main tread surface, a step front, side struts and a rear surface of the main tread surface including a rear transverse rib, the kit comprising a transverse stiffener mountable to the rear surface and comprising a base dimensioned for flush mounting against the rear surface at a location adjacent the rear transverse rib, a first side extending rearwardly from the base along a first transverse edge thereof and adapted and dimensioned to be in contact with the rear transverse rib, and a second side extending rearwardly from the base along a second transverse edge thereof; first and second side plates each having a plate body for mounting against one of the side struts with an upper rim adapted to rest against a rear surface of the step body and a front rim adapted to rest against a rear side of the step front; and mounting means to rigidly affix each of the transverse stiffeners and first and second side plates to the step body.

2. The reinforcement unit of claim 1, wherein the step body includes reinforcing ribs, said transverse stiffener having recesses located to accept said reinforcing ribs.

3. The reinforcement unit of claim 1, wherein said transverse stiffener is formed as a metal plate having a plurality of longitudinally-extending bends.

4. The reinforcement kit of claim 1, wherein each of said side plates have a ring to enclose a stub axle pin mounted to the side strut to support a guide roller.

* * * * *